US006548953B1

(12) United States Patent
Van Eck

(10) Patent No.: US 6,548,953 B1
(45) Date of Patent: Apr. 15, 2003

(54) ELECTRON GUN FOR A CATHODE RAY TUBE WITH ELECTRICAL CONDUCTORS WELDED TO BRACKET BASE, AND CATHODE RAY TUBE PROVIDED WITH SUCH A GUN

(75) Inventor: Arnoldus Hubertus Maria Van Eck, Son (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 203 days.

(21) Appl. No.: 09/696,586

(22) Filed: Oct. 25, 2000

(30) Foreign Application Priority Data

Oct. 27, 1999 (EP) ..... 99203539

(51) Int. Cl.[7] ..... H01J 29/46
(52) U.S. Cl. ..... 313/456; 313/457; 313/414
(58) Field of Search ..... 313/456, 457, 313/412, 414; 315/3

(56) References Cited

U.S. PATENT DOCUMENTS 3,838,306 A * 9/1974 Jenne, Jr. ..... 313/256
4,305,018 A * 12/1981 Paridaens ..... 313/417
4,786,842 A * 11/1988 Shimoma et al. ..... 313/417
5,479,067 A * 12/1995 van der Wilk et al. ..... 313/417

FOREIGN PATENT DOCUMENTS

EP 0453978 A1 10/1991 ..... H10J/29/48

* cited by examiner

*Primary Examiner*—Ashok Patel
*Assistant Examiner*—Glenn Zimmerman

(57) ABSTRACT

An electron gun (1) for use in a cathode ray tube has brackets (20) connecting grids (2, 3, 4, 5, 6) to insulator rods (10). Electric conductors (11) extending to contact pins (12) embedded in a glass flange (13) are welded to a base (21) of the brackets (20). Legs (25) extend from the base (21) and are welded to the grids (2, 3, 4, 5, 6). Lugs (26) extend from the base (21) in opposite directions and are embedded in the glass rods (10). The brackets (20) provides stability to the grids (2, 3, 4, 5, 6), thereby preventing varying properties of guns (1) from one batch. The cathode ray tube is provided with the gun (1).

8 Claims, 2 Drawing Sheets

ELECTRON GUN FOR A CATHODE RAY TUBE WITH ELECTRICAL CONDUCTORS WELDED TO BRACKET BASE, AND CATHODE RAY TUBE PROVIDED WITH SUCH A GUN

BACKGROUND OF THE INVENTION

The invention relates to an electron gun for a cathode ray tube, comprising:

insulator rods in the longitudinal direction l of the row, aside from the row of grids, which insulator rods maintain the grids positioned with respect to each other;

metal brackets having a base and juxtaposed legs on sides of the base, said legs of each bracket being welded to the lateral wall of a respective bush-shaped grid and being embedded in a respective insulator rod by means of their lugs, which lugs face away from the legs.

The invention also relates to a cathode ray tube provided with such an electron gun.

An electron gun of this type is known from EP-A-0 453 978.

It is important for the sharpness of the image, which is produced by means of the gun in a cathode ray tube, that the grids of the gun are mutually aligned within narrow tolerances. To this end, the grids of the gun are mechanically secured to each other by means of insulator rods of, for example, glass, while they are maintained aligned with respect to each other by means of, for example, a jig. After mechanical assembly of the gun, electric conductors are secured to the grids, which conductors are connected to contact pins embedded in an insulating, for example glass, flange. At a later stage, a fuse is made at this flange with the neck of a cathode ray tube.

The known electron gun is manufactured by first embedding the metal brackets in the insulator rods, by subsequently welding the brackets to the bush-shaped grids while maintaining them aligned with respect to each other and by subsequently welding the electric conductors to the grids.

The brackets of the known electron gun have their legs on the shorter sides of the base. The legs are outwardly flanged and welded joints with the grids are realized on the flanged portions, aside from the insulator rods. The base extends transversely to the insulator rods and is entirely shielded by an insulator rod. The lugs embedded in an insulator rod are bent from the plane of the base on its longer sides and face away from the legs.

Another electron gun known from the quoted document has U-shaped brackets. The base of these brackets completely engages the grids and is welded thereto. The legs themselves are embedded in the insulator rods. The brackets have no lugs.

Yet another electron gun known from this document also has U-shaped brackets whose legs are outwardly flanged. The base of the brackets is completely embedded in the insulator rods. Welded joints with the grids are realized on the flanged portions of the legs which project laterally from the insulator rods. Also these brackets have no lugs.

With the construction of the known electron gun described in the opening paragraph, it is envisaged, likewise as with the two other known electron guns, to prevent differences in size and mutual position of the grids in electron guns from one batch. Such differences affect the properties of the electron gun, notably the sharpness of the image given by a cathode ray tube provided with the electron gun.

It is a drawback of the known electron guns there is still a relatively large spread of the properties of the guns from one batch. This spread might lead to deformation of the grids during assembly of the electron guns when a first bracket embedded in an insulator rod already makes contact with a first grid while the insulator rod must still be further moved towards the grids so as to bring the other brackets into contact with the other grids.

SUMMARY OF THE INVENTION

It is an object of the invention to provide an electron gun of the type described in the opening paragraph in which the risk of spread of properties of guns from one batch is obviated.

According to the invention, this object is achieved in that the base of the brackets extends as far as the side of the relevant insulator rod, and in that electric conductors are welded to the base, which electric conductors are connected to contact pins embedded in an insulating flange.

The invention is based on the recognition that deformations of the grids and hence disturbance of their aligned position may be the result when the conductors are welded to the grids themselves, as is the case in the known electron gun. In the electron gun according to the invention, this is obviated in that the conductors are welded to the base of the brackets. The brackets stiffen the grids and, during welding, constitute a mechanical and thermal buffer for the grids themselves. Moreover, the electron gun may be made in a conventional manner by welding the brackets to the grids prior to the alignment step. The local thermal and mechanical load of the grids resulting from the welding operation then occurs prior to the alignment. Another advantage is that the grids are then still accessible internally and externally so that not only laser welding but also, for example, resistance welding is still possible.

Individual guns of a batch of electron guns according to the invention have mutually different properties to a small extent only and are substantially equal for practical applications.

The legs of the brackets may extend in the longitudinal direction l of the row, for example, parallel to the insulator rods. However, it is favorable when the legs are transverse to the longitudinal direction l of the row. The legs then have a relatively large width and a relatively long contact with the grid. Welds can then be made on the grid at locations which are spaced far apart on each of the two legs so that the grid is mechanically strengthened to a large extent.

To this end, it is favorable when the base has longer sides and the legs have a width which essentially corresponds to the longer sides of the base. Then they have a relatively long contact line with the grids.

The lugs of the brackets may be situated in areas transverse to the legs, for example, along sides of the base and connected thereto. However, it is favorable when the lugs are cut loose from the base and are bent outwards, for example, transverse to the longer sides of the base and leaving an opening in the base. This embodiment limits the quantity of material for the brackets.

In a variant of this embodiment, the lugs extend in alignment with the legs. This variant has the advantage that the lugs are spaced far apart, just as far as the legs, and the brackets yield a very stable coupling with the insulator rods. An important advantage is, however, the simplicity of manufacture of the brackets. When an in-plano of the brackets is obtained by means of, for example, punching from, for example, sheet material, bending in only one direction needs to take place only twice for realizing this variant so as to bend the legs, and simultaneously the lugs, from the plane of the base. Moreover, the two bending operations may be easily performed simultaneously in one operating step. This variant is superior to the bracket of the known electron gun, both as far as material quantity and simplicity of manufacture and function are concerned.

It is favorable when the brackets extend on both sides as far as the sides of the insulator rod. It is then possible to connect the electric conductors on the one or the other side of the one or the other insulator rod to the brackets and hence space each conductor relatively far apart from the other.

It is favorable when each leg of the brackets is entirely located in a flat plane so that they do not have any flanged end portions. In this embodiment, the brackets can only be secured to the grids by means of butt-welding. In contrast to welding on flanged portions of the legs, the brackets then give the grids great stiffness and stability. Furthermore, the material quantity required for the brackets is smaller and their manufacture is simpler.

It is favorable when the insulator rods consist of glass.

The electron gun according to the invention may be designed for generating only one electron beam in a monochrome cathode ray tube, or for generating three electron beams in a multichrome cathode ray tube. In such a cathode ray tube, a multitude of colors is generated by means of phosphors in three colors, for example, red, green and blue.

The cathode ray tube according to the invention may be a monochrome tube or a multichrome tube. The tube may be intended for use as a computer monitor, in a television receiver, or in an oscilloscope.

These and other aspects of the invention are apparent from and will be elucidated with reference to the embodiments described hereinafter.

DESCRIPTION OF THE PREFERRED EMBODIMENT

Figure 1:
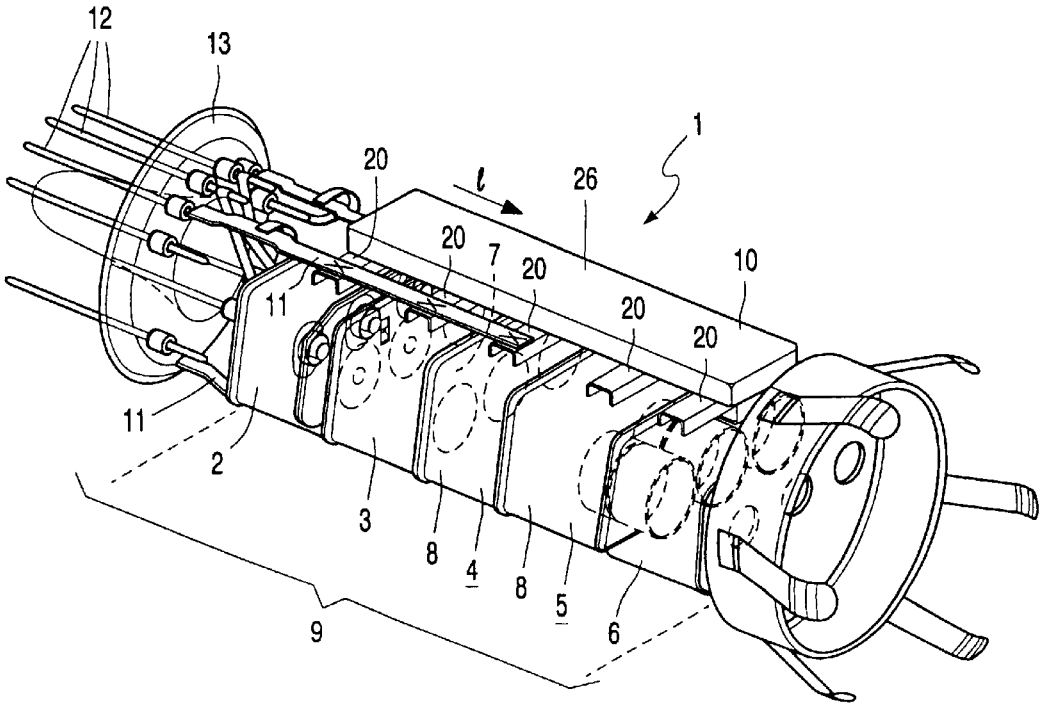
FIG. 1 is a diagrammatic perspective view of the electron gun.

In FIG. 1, the electron gun 1 for a cathode ray tube is provided with bush-shaped grids 2, 3, 4, 5, 6 having a bottom wall 7 and, extending therefrom, a circumferential lateral wall 8. The grids 2, 3, 4, 5, 6 are arranged in a row 9 having a longitudinal direction l, with the bottom walls 7 transverse to the row 9. Insulator rods 10, of glass in the Figure (see also FIG. 2), are present in the longitudinal direction l of the row 9, aside from the row 9 of grids 2, 3, 4, 5, 6. The insulator rods 10 maintain the grids 2, 3, 4, 5, 6 positioned with respect to each other. The electron gun also has metal brackets 20 (see also FIGS. 2 and 3) with a base 21 and juxtaposed legs 25 on sides 22 of the base 21. The legs 25 of each bracket 20 are welded to the lateral wall 8 of a bush-shaped grid 2, 3, 4, 5, 6, respectively. They have lugs 26 with which they are embedded in a respective insulator rod 10. The lugs 26 face away from the legs 25. The electron gun shown supplies three electron beams during operation, so that it is suitable for use in a color display tube.

The base 21 of the brackets 20 extends as far as the side of the relevant insulator rod 10, and electric conductors 11 are welded to the base 21. Welding spots are denoted by x in FIG. 1. The conductors are connected to contact pins 12 which are embedded in an insulating flange 13.

In the embodiment shown, the legs 25 are transverse to the longitudinal direction l of the row 9.

Figure 2:
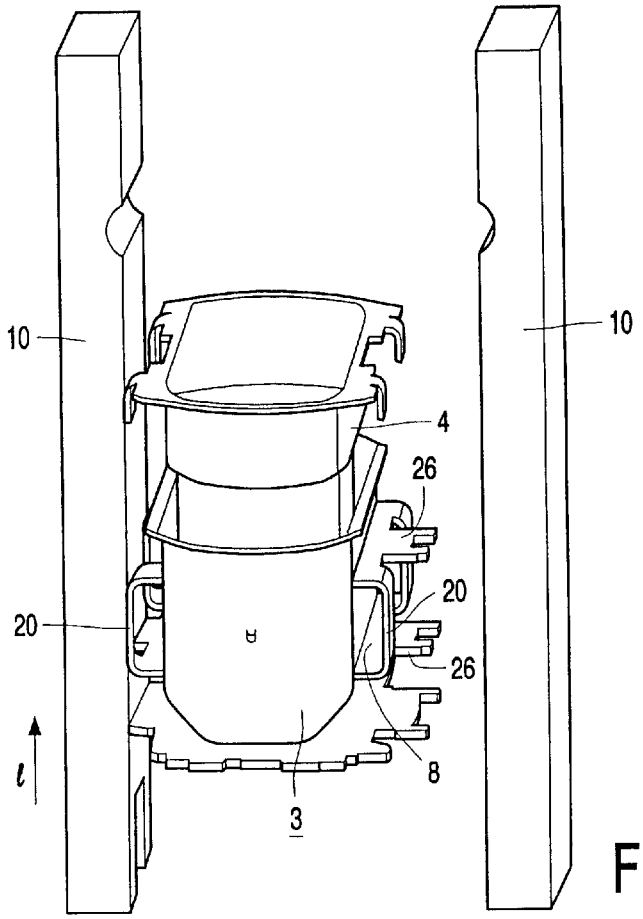
FIG. 2 is a detail of the electron gun of FIG. 1, partly in an exploded view.
Figure 3:
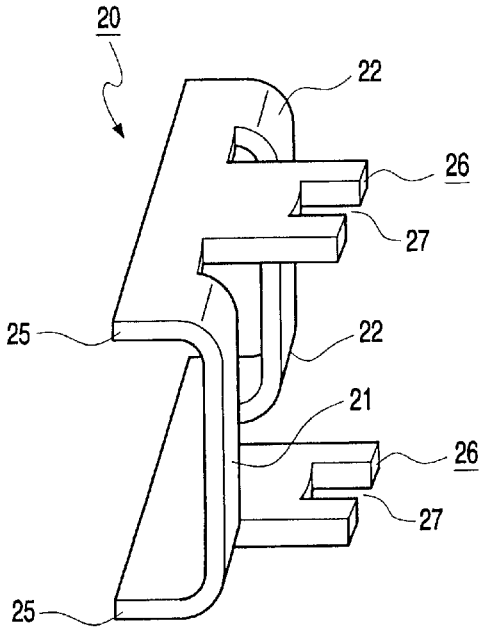
FIG. 3 is a perspective view of the bracket shown in FIGS. 1 and 2.

The base 21 has longer sides 22 and, as is apparent from FIGS. 2 and 3, the legs 25 have a width which essentially corresponds to the longer sides 22 of the base 21.

For the sake of clarity, FIG. 2 shows a situation which does not occur in the manufacture of the electron gun. Grid 3 is provided with brackets 20, whereas grid 4 is not yet provided with brackets. One bracket 20 is embedded in an insulator rod 10 by means of its lugs 26, whereas the other bracket is not yet embedded in the second rod 10.

As is apparent from FIGS. 2 and 3, the lugs 26 are cut loose from the base 21 and are bent outwards. The lugs 26 extend in alignment with the legs 25. When the in-plano of the bracket is obtained by means of, for example, punching from sheet material and the in-plano is bent around the longer sides 22 of the base 21 so as to place the legs 25 transverse to the base 21, the lugs 26 raise themselves automatically.

FIG. 3 shows that each lug 26 has a recess 27. The recess 27 widens from the end of the lug 26 so that the recess 27 has a swallowtail shape. The lugs 26 thus interlock with the insulator rods 10 (FIGS. 1 and 2).

It is apparent from FIG. 2 and also from FIG. 3 that, due to the symmetry of the shown brackets 20, the brackets 20 extend on both sides as far as the sides of the insulator rod 10. The insulator rods 10 are only a little bit wider than the lugs 26. Each leg 25 of the brackets 20 is entirely located in a flat plane.

In the embodiment shown, the brackets 20 have butt welds on the grids 2, 3, 4, 5, 6. The legs 25 are transverse to the lateral walls 8 and the legs 25 have a relatively large width and a relatively long contact line with the lateral walls 8. Consequently, the brackets 20 give the grids 2, 3, 4, 5, 6 great stiffness and stability.

Figure 4:
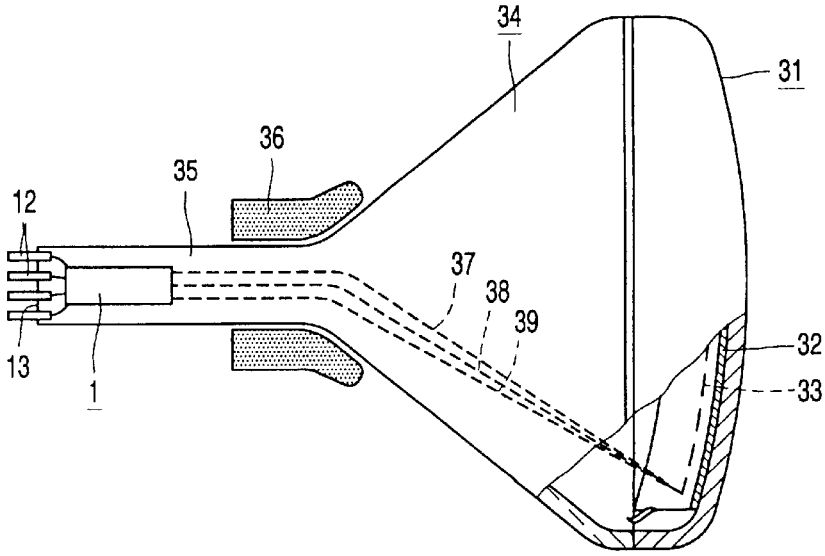
FIG. 4 is a side elevation of the cathode ray tube with the electron gun shown in FIG. 1, partly broken away.

The cathode ray tube of FIG. 4 has a screen 31, an inner surface of which has a coating 32 with areas provided with blue, green and red luminescing material. During operation, these areas are impinged by electron beams 37, 38 and 39 via apertures in a shadow mask 33. The screen 31 is fused to a cone 34 having a neck 35 with which the flange 13 of the electron gun 1 is fused. A deflection coil 36 guides the electron beams 37, 38 and 39 towards their target on the screen 31. The tube 31 shown is a color display tube with the threefold electron gun 1.

What is claimed is:

1. An electron gun for a cathode ray tube comprising:

bush-shaped grids, each having a bottom wall and, extending therefrom, a circumferential lateral wall, the grids being arranged in a row having a longitudinal direction l, with the bottom walls transverse to the row;

insulator rods extending in the longitudinal direction l of the row and alongside the row, said insulator rods maintaining the grids positioned with respect to each other;

metal brackets having a base and juxtaposed legs on sides of the base, the legs of each said bracket being welded to the lateral wall of a respective one of the bush-shaped grids and being embedded in a respective one of the insulator rods by means of lugs extending from the brackets, said lugs facing away from the respective legs, the base of each of the brackets extending as far as the side of the respective insulator rod, and electric conductors being welded to the bases and electrically connected to contact pins embedded in an insulating flange.

2. An electron gun as claimed in claim 1, characterized in that the legs are transverse to the longitudinal direction l of the row of the grids.

3. An electron gun as claimed in claim 2, characterized in that the base has longer sides and the legs have a width which essentially corresponds to the longer sides of the base.

4. An electron gun as claimed in claim 1, characterized in that the lugs are cut loose from the base and are bent outwards.

5. An electron gun as claimed in claim 2, characterized in that the lugs extend in alignment with the legs.

6. An electron gun as claimed in claim 1, characterized in that the brackets extend on both sides as far as the sides of the insulator rod.

7. An electron gun as claimed in claim 1, characterized in that each said leg of the brackets is entirely located in a flat plane.

8. A cathode ray tube provided with the electron gun as claimed in claim 1.

* * * * *